US009295299B2

(12) United States Patent
Leary et al.

(10) Patent No.: US 9,295,299 B2
(45) Date of Patent: Mar. 29, 2016

(54) FORM-FITTING ARTICLES AND METHOD FOR CUSTOMIZING ARTICLES TO BE FORM-FITTED

(75) Inventors: Kevin Leary, Dedham, MA (US); Paul Shinney, Milton, MA (US); Paul E. Litchfield, Westboro, MA (US); William McInnis, Westwood, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 700 days.

(21) Appl. No.: 13/457,201

(22) Filed: Apr. 26, 2012

(65) Prior Publication Data

US 2012/0204320 A1 Aug. 16, 2012

Related U.S. Application Data

(63) Continuation of application No. 13/087,275, filed on Apr. 14, 2011, now Pat. No. 9,185,946, which is a continuation-in-part of application No. 12/579,096, filed on Oct. 14, 2009.

(51) Int. Cl.
*A41D 19/00* (2006.01)
*A41D 13/08* (2006.01)
(Continued)

(52) U.S. Cl.
CPC . *A43B 1/04* (2013.01); *A42C 2/007* (2013.01); *A43B 1/0027* (2013.01); *A43B 1/0072* (2013.01); *A43B 5/00* (2013.01); *A43B 7/1465* (2013.01); *A43B 7/28* (2013.01); *A43B 17/02* (2013.01); *A43B 23/028* (2013.01);
(Continued)

(58) Field of Classification Search
CPC ..... A41D 19/00; A41D 19/01594; A41D 19/01523; A63B 71/146
USPC ..... 2/161.1, 161.4, 161.6, 161.8, 19, 159; 608/50; 607/50
See application file for complete search history.

(56) References Cited

U.S. PATENT DOCUMENTS 3,362,091 A 1/1968 Drago
3,613,271 A 10/1971 Geller
(Continued)

FOREIGN PATENT DOCUMENTS

EP 0 507 322 10/1992
EP 1 415 558 5/2004
WO WO 97/22273 6/1997

OTHER PUBLICATIONS

Insert included with U+ Pro hockey skate sold by CCM Hockey, Apr. 2008, 2 pgs.
(Continued)

*Primary Examiner* — Robert J Hicks
*Assistant Examiner* — Timothy K Trieu
(74) *Attorney, Agent, or Firm* — Sterne, Kessler, Goldstein & Fox PLLC

(57) ABSTRACT

Customized, form-fitting athletic articles with a heat moldable material that a wearer may heat to soften after purchase to conform the heat moldable material so the contours of the wearer's body may provide many advantages for consumers, such as increased comfort, performance, or safety. The heat moldable material may be incorporated into an athletic glove. The heat moldable material may be reusable in that it may be reheated and remolded multiple times so that the article may be re-customized or re-fitted as needed. The article may also include a temperature sensitive indicator that indicates when the heat moldable material has been softened.

31 Claims, 15 Drawing Sheets

(51) Int. Cl.

| | |
|---|---|
| ***A43B 1/04*** | (2006.01) |
| ***A43B 1/00*** | (2006.01) |
| ***A42C 2/00*** | (2006.01) |
| ***A43B 5/00*** | (2006.01) |
| ***A43B 7/14*** | (2006.01) |
| ***A43B 7/28*** | (2006.01) |
| ***A43B 17/02*** | (2006.01) |
| ***A43B 23/02*** | (2006.01) |
| ***A63B 71/14*** | (2006.01) |
| *A63B 71/12* | (2006.01) |

(52) U.S. Cl.

CPC ..... *A43B23/0215* (2013.01); *A43B 23/0235* (2013.01); *A63B 71/1225* (2013.01); *A63B 71/143* (2013.01); *A63B 71/12* (2013.01); *A63B 71/148* (2013.01); *A63B 2071/1208* (2013.01); *A63B 2071/1258* (2013.01); *A63B 2071/1266* (2013.01); *A63B 2071/1283* (2013.01); *A63B 2102/18* (2015.10); *A63B 2243/0004* (2013.01); *A63B 2243/0025* (2013.01)

(56) References Cited

U.S. PATENT DOCUMENTS

| | | | | |
|---|---|---|---|---|
| 3,760,056 | A | 9/1973 | Rudy | |
| 4,433,494 | A | 2/1984 | Courvoisier et al. | |
| 4,910,803 | A * | 3/1990 | Cukier | 2/168 |
| 4,964,229 | A | 10/1990 | Laberge | |
| 5,035,069 | A | 7/1991 | Minden | |
| 5,175,886 | A * | 1/1993 | Suk | 2/161.2 |
| 5,401,564 | A | 3/1995 | Lee et al. | |
| 5,527,244 | A * | 6/1996 | Waller et al. | 482/47 |
| 5,529,826 | A | 6/1996 | Tailor et al. | |
| 5,555,584 | A | 9/1996 | Moore, III et al. | |
| 5,591,221 | A * | 1/1997 | Owens | 607/111 |
| 5,667,857 | A | 9/1997 | Watanabe et al. | |
| 5,673,448 | A | 10/1997 | Lang et al. | |
| 5,714,098 | A | 2/1998 | Potter | |
| 5,733,647 | A | 3/1998 | Moore, III et al. | |
| 5,746,015 | A | 5/1998 | Clement et al. | |
| 5,879,725 | A | 3/1999 | Potter | |
| 5,893,222 | A | 4/1999 | Donnelly | |
| 5,924,218 | A | 7/1999 | Dalvy et al. | |
| 5,940,991 | A | 8/1999 | Cabalquinto | |
| 6,305,022 | B1 * | 10/2001 | Oomura et al. | 2/19 |
| 6,346,210 | B1 | 2/2002 | Swartz et al. | |
| 6,618,961 | B1 | 9/2003 | Palau | |
| 6,670,029 | B2 | 12/2003 | Norton et al. | |
| 6,681,402 | B1 * | 1/2004 | Bevier et al. | 2/19 |
| 6,703,142 | B2 | 3/2004 | Snow | |
| 6,732,455 | B2 | 5/2004 | Bordin et al. | |
| 6,766,531 | B2 * | 7/2004 | Sullivano et al. | 2/19 |
| 7,340,851 | B2 | 3/2008 | Litchfield et al. | |
| 7,395,617 | B2 | 7/2008 | Christensen et al. | |
| 7,958,993 | B2 | 6/2011 | Baker et al. | |
| 2003/0056399 | A1 | 3/2003 | Baek | |
| 2007/0199208 | A1 | 8/2007 | Wilkenfeld | |
| 2009/0293318 | A1 | 12/2009 | Garneau et al. | |
| 2011/0114515 | A1 | 5/2011 | Baker et al. | |
| 2012/0180191 | A1 * | 7/2012 | McNamee | 2/158 |

OTHER PUBLICATIONS

European Examination Report, Application No. EP 09 179 451.1, dated Mar. 4, 2015, 4 pages.

* cited by examiner

FORM-FITTING ARTICLES AND METHOD FOR CUSTOMIZING ARTICLES TO BE FORM-FITTED

CROSS REFERENCE TO RELATED APPLICATIONS

This application is a continuation of U.S. application Ser. No. 13/087,275, filed on Apr. 14, 2011, which is a continuation-in-part of U.S. application Ser. No. 12/579,096, filed on Oct. 14, 2009, the disclosures of which are hereby incorporated in their entirety by reference thereto.

BACKGROUND OF THE INVENTION

1. Field of the Invention

The present invention is directed to form-fitting articles, such as athletic shoes, and a method for providing customized form-fitted articles.

2. Background Art

Individuals are concerned with fit when buying items to be worn, such as articles of footwear or sportswear. For example, while articles of footwear and sportswear come in a variety of sizes, it is rare to find an article of footwear or sportswear that is the perfect fit. Often, in the case of footwear, individuals must buy additional inserts such as heel grippers to prevent the wearer's foot from rubbing against the heel of the shoe or arch supports to support the arch and prevent pronation. In some instances, individuals may have two differently shaped feet so that it is necessary to buy footwear having a different size and/or width for each foot. However, a vast majority of individuals ignore the less than perfect fit and in so doing minimize their comfort, performance, and, sometimes, safety. One potential side effect of not having a good fit is that it may lead to injury over time. Comfort, performance, and injury prevention are important to everyone, but are particularly important to athletes.

In the past, heat moldable materials have been used in some ski boots along with rigid, inflexible outer shells. The heat moldable material was generally a thick foam liner or stiffener that could be molded to the contour of a wearer's foot. In general, such ski boots were designed for stiffness and support and the heat moldable materials used were generally semi-rigid, foam-based materials that would lose their ability to reform upon repeated heat molding.

Also in the past, some heat moldable materials have been used as heel counters and toe boxes in non-athletic, dress shoes. The heat moldable material used was generally thick, designed for stiffness, and any purposeful heat molding is thought to have been limited to that done in the shoe factory.

Accordingly, a need exists for articles of footwear and sportswear that can be customized and form-fitted to an individual that include a flexible and reusable heat moldable material.

BRIEF SUMMARY OF THE INVENTION

A customized, form-fitting athletic shoe that results from conforming a heat moldable material to the contours of the wearer's body provides many advantages for consumers. For instance, it may facilitate the process of buying shoes, as it may eliminate the need to by different size and/or width shoes for each foot if an individual has differently shaped feet. The process of fitting the heat moldable material to each wearer's body to provide a customized form-fit shoe may be accomplished with identical sized shoes. Such a customized, form-fitting athletic shoe may also provide increased comfort, performance, or safety to the wearer. In some embodiments, the heat moldable material may be sufficiently flexible so as not to impede the necessary movements of a wearer or the athletic shoe while performing activities, such as running, walking, jumping, etc. In some embodiments, the heat moldable material may be reusable in that it may be reheated and remolded multiple times so that the athletic shoe may be re-customized or re-fitted as needed. Such a shoe can be re-customized or re-fitted to a wearer's changing footwear requirements or re-customized or re-fitted to a different individual.

In one embodiment, an athletic shoe may include a sole and an upper connected to the sole. The upper may have a forefoot region, a heel region, and a midfoot region between the forefoot region and the heel region. The upper may also have a flexible outer layer, a lining connected to the flexible outer layer, and a flexible heat moldable sheet disposed between the outer layer and the lining at least in a portion of the midfoot region. The flexible heat moldable sheet may be configured to conform to a wearer's body (e.g., a portion of a wearer's foot, ankle, lower leg, or combination thereof) when heated to a predetermined temperature to provide the wearer with a customized fit for the athletic shoe. In some embodiments, the flexible heat moldable sheet may comprise a fabric and a thermoplastic resin. In some embodiments, the flexible heat moldable sheet may comprise a thermoplastic resin and does not comprise a fabric. In some embodiments, the flexible heat moldable sheet may be formed of a material which allows the sheet to be reusable so that it may be molded multiple times to conform to the wearer.

In another embodiment, an upper of an athletic shoe may include a forefoot region, a heel region, and a midfoot region between the forefoot region and the heel region. The upper may also have a flexible outer layer, a lining connected to the flexible outer layer, and a flexible heat moldable sheet substantially contacting the outer layer and the lining at least in a portion of the midfoot region. The flexible heat moldable sheet may be configured to conform to a wearer's body (e.g., a portion of a wearer's foot, ankle, lower leg, or combination thereof) when heated to a predetermined temperature to provide the wearer with a customized fit for the upper. In some embodiments, the flexible heat moldable sheet may comprise a fabric and a thermoplastic resin. In some embodiments, the flexible heat moldable sheet may comprise a thermoplastic resin and does not comprise a fabric. In some embodiments, the flexible heat moldable sheet may be formed of a material which allows the sheet to be reusable so that it may be molded multiple times to conform to the wearer.

In another embodiment, an athletic shoe may include a sole and an upper connected to the sole. The upper may have a heat moldable sheet configured to conform to a wearer's body (e.g., a portion of a wearer's foot, ankle, lower leg, or combination thereof) when heated to a predetermined temperature. The athletic shoe may also include a temperature sensitive indicator configured to undergo a visible change when the predetermined temperature is reached, such as a change in color.

In a further embodiment, a method for providing a customized fit of an athletic shoe for a wearer includes providing an athletic shoe. The athletic shoe may include a sole and an upper connected to the sole. The upper may have a forefoot region, a heel region, and a midfoot region between the forefoot region and the heel region. The upper may also have a flexible outer layer, a lining connected to the flexible outer layer, and a flexible heat moldable sheet disposed between the outer layer and the lining at least in a portion of the midfoot region. The flexible heat moldable sheet may be configured to conform to a wearer's body (e.g., a portion of a wearer's foot, ankle, lower leg, or combination thereof) when heated to a predetermined temperature to provide the wearer with a customized fit for the athletic shoe. In some embodiments, the flexible heat moldable sheet may also comprise a fabric and a thermoplastic resin. In some embodiments, the flexible heat moldable sheet may comprise a thermoplastic resin and does not comprise a fabric. The athletic shoe may be heated at a predetermined temperature for a predetermined amount of time. Then, a wearer may insert their foot into the athletic shoe to allow the flexible heat moldable sheet to conform to the wearer.

In another embodiment, a glove may include a first outer layer and a second outer layer with a flexible heat moldable layer therebetween. The flexible heat moldable material may be configured to conform to a wearer's body (e.g., a portion of a hand, wrist, arm, or combination thereof) when heated to a predetermined temperature to provide the wearer with a customized fit for the glove. In some embodiments, the flexible heat moldable sheet may also comprise a fabric and a thermoplastic resin. In some embodiments, the flexible heat moldable sheet may comprise a thermoplastic resin and does not comprise a fabric. In some embodiments, the flexible heat moldable layer may be formed of a material which allows the layer to be reusable so that it may be molded multiple times to conform to the wearer.

In another embodiment, a hat may include a heat moldable layer attached to an interior of the hat. The heat moldable layer may be configured to conform to a wearer's head when heated to a predetermined temperature to provide the wearer with a customized fit for the hat. In some embodiments, the flexible heat moldable sheet may also comprise a fabric and a thermoplastic resin. In some embodiments, the flexible heat moldable sheet may comprise a thermoplastic resin and does not comprise a fabric. In some embodiments, the heat moldable layer may be formed of a material which allows the layer to be reusable so that it may be molded multiple times to conform to the wearer's head.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
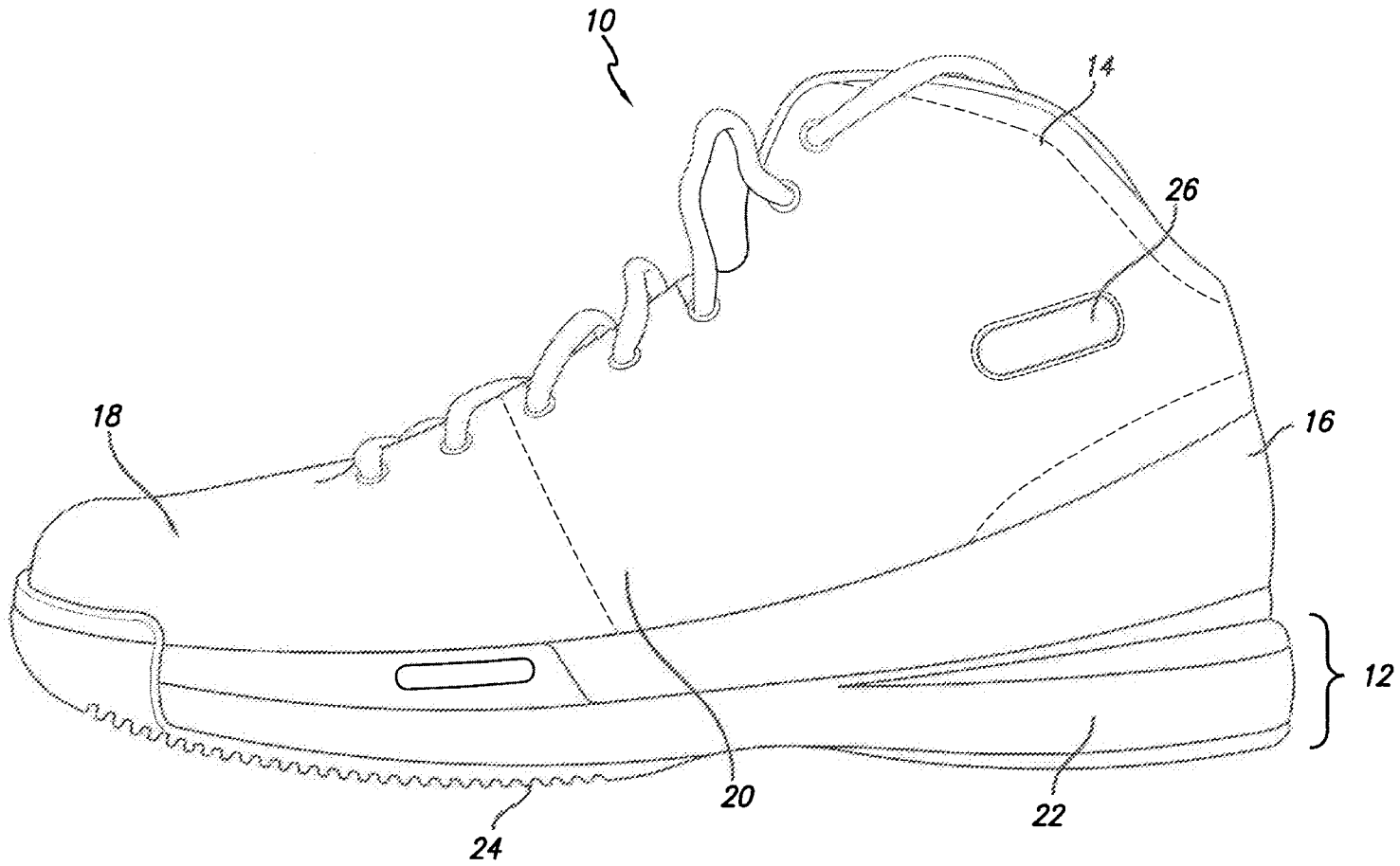
FIG. 1 is a lateral side view of an exemplary article of footwear according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

A customized, form-fitting article of footwear, such as an athletic shoe, may include a heat moldable material that conforms to the wearer's foot, ankle, or leg when heated to a predetermined temperature to provide a customized, form-fit. The heat moldable material may be sufficiently flexible for use in athletic shoes so that movement of the foot or shoe is not hampered by the presence of the heat moldable material. While the heat moldable material is described as being implemented in an article of footwear, this is a non-limiting example and the heat moldable material may be included in other articles to provide a customized, form-fit, such as for example, sporting equipment (e.g., helmets, helmet liners, chest protectors, am protectors, rib pads, shin guards, spats, baseball gloves, goalie gloves, etc.) or articles of clothing (e.g., gloves, hats, etc.).

Figure 2:
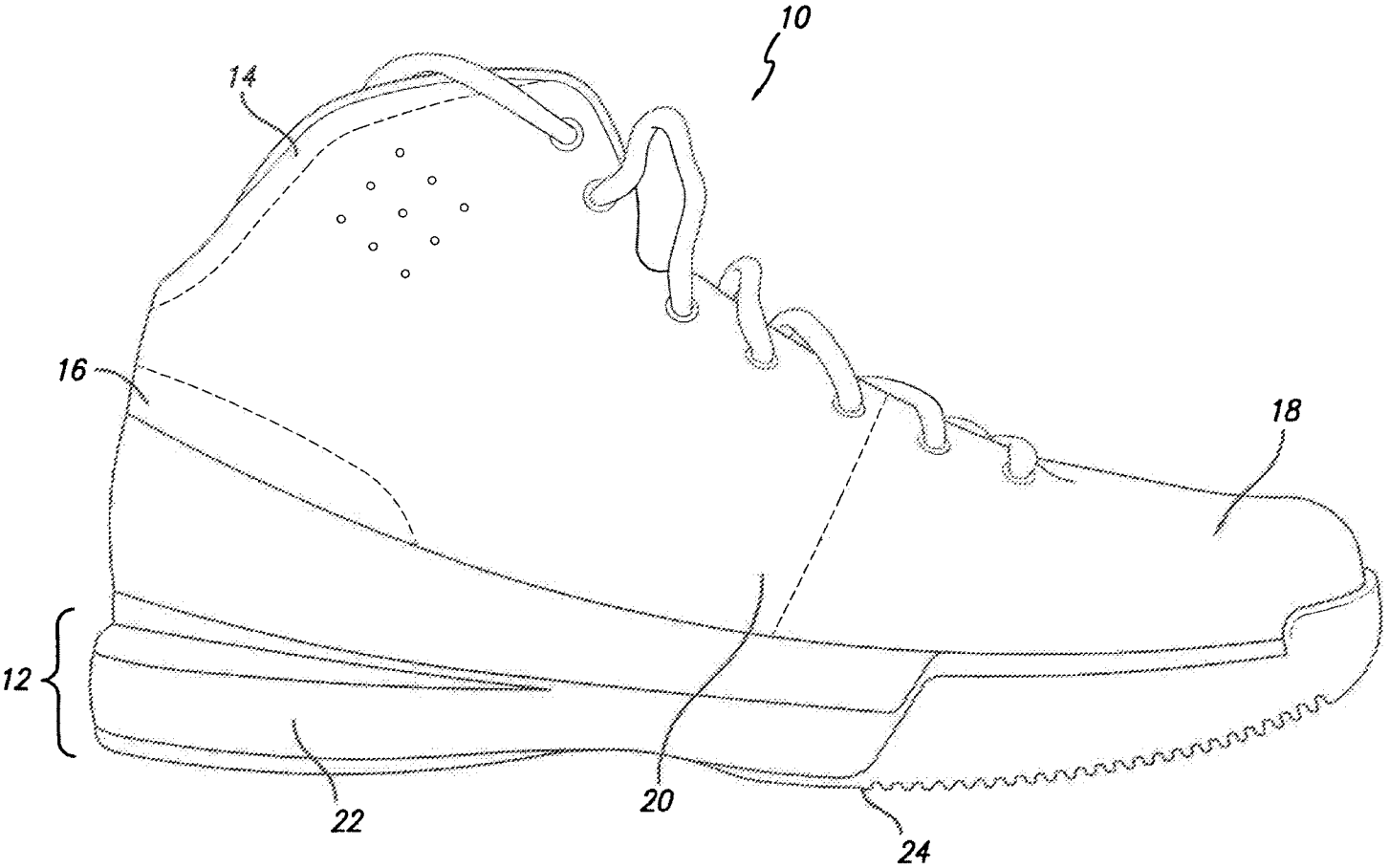
FIG. 2 is a medial side view of the exemplary article of footwear of FIG. 1 according to an embodiment of the present invention.
Figure 3:
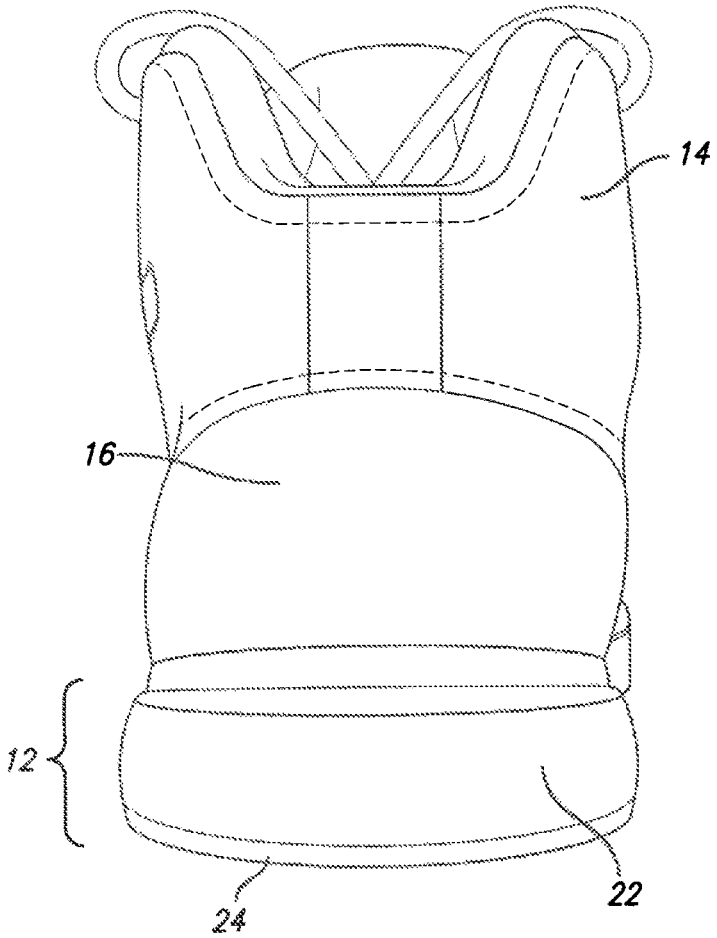
FIG. 3 is a rear view of the exemplary article of footwear of FIG. 1 according to an embodiment of the present invention.

Referring to the drawings and in particular to FIGS. 1-3, an exemplary embodiment of an article of footwear, in particular an athletic shoe, according to the present invention generally referred to by reference numeral 10 is shown. Although the article of footwear 10 may be referred to herein as shoe 10, it is contemplated that it may comprise any type of footwear in which the customized, form-fitting feature of the present invention may be desirable, including, but not limited to, athletic shoes (e.g., walking shoes, running shoes, basketball shoes, court shoes, tennis shoes, cleated shoes, and training shoes), skates (e.g., roller, inline, and ice skates), boots (e.g., ski boots and snowboarding boots), and sandals. The article of footwear may include a traditional closure system such as, for example, laces or straps.

Figure 4:
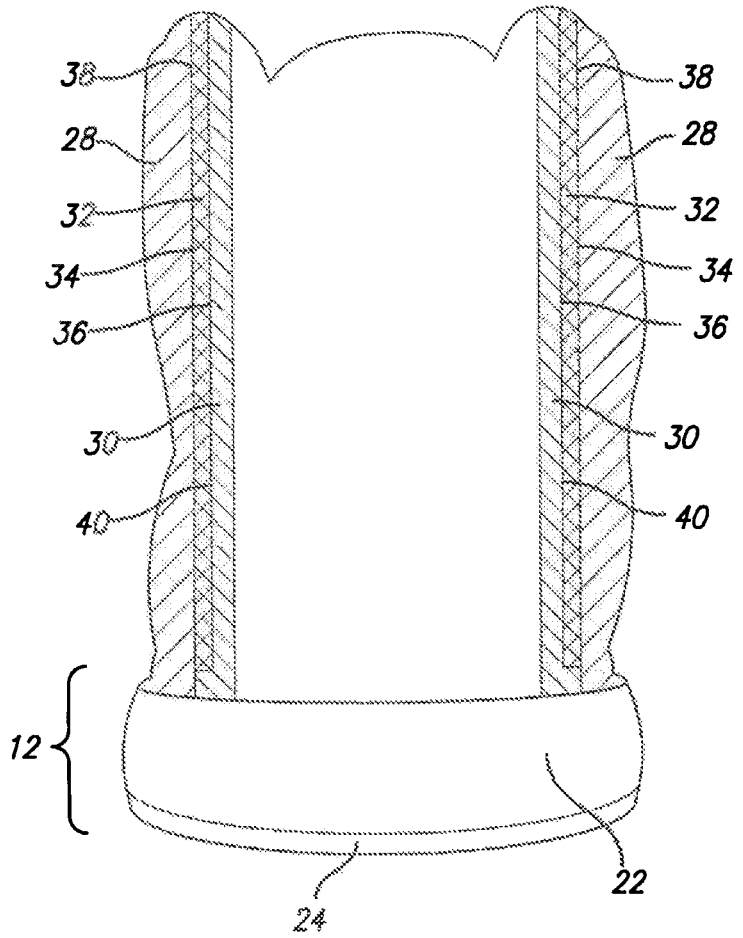
FIG. 4 is a rear cross-sectional view of the exemplary article of footwear of FIG. 1 according to an embodiment of the present invention.

As shown in FIGS. 1-3, shoe 10 may have a sole 12 and an upper 14 connected to sole 12. Shoe 10 may have a heel region 16, a forefoot region 18, and a midfoot region 20 located between heel region 16 and forefoot region 18. Sole 12 may include a midsole 22 and an outsole 24. Shoe 10 may include a temperature sensitive indicator 26, which is discussed in more detail below. As shown in FIG. 4, upper 14 may include an outer layer 28, an interior lining 30, and a heat moldable material or sheet 32 located therebetween. Outer layer 28 may be flexible and may be any flexible material typically utilized for an upper, including, but not limited to, leather, canvas, fabric, polymeric materials, fluid-finable bladders, and combinations thereof. Interior lining 30 may also be any material typically utilized in articles of footwear including, but not limited to, traditional shoe linings, fluid-fillable bladders, foam layers, and combinations thereof. Fluid-fillable bladders suitable for use in footwear include, but are not limited to, bladders like those described in U.S. Pat. No. 7,395,617 to Christensen, et al. and U.S. Pat. No. 7,340,851 to Litchfield, et al., the disclosures of which are incorporated herein in their entirety by reference.

In some embodiments, outer layer 28 or interior lining 30 may be porous or perforated. In some instances, upper 14 may include outer layer 28 and interior lining 30 and also heat moldable material or sheet 32 and at least one additional layer of padding (e.g., foam or fabric padding) located between the outer layer and interior lining. In particular embodiments, upper 14 may consist essentially of outer layer 28, interior lining 30, and heat moldable material or sheet 32, wherein no additional comfort padding is present. In such instances, the ability of the heat moldable material 32 and interior lining 30 to closely form to a wearer can alleviate the need for additional comfort padding.

In some embodiments as shown in FIG. 4, heat moldable material or sheet 32 may be located between outer layer 28 and interior lining 30 of upper 14. However, in other embodiments heat moldable material may be the innermost surface of upper 14 or may be the outermost surface of upper 14. For example, heat moldable material or sheet 32 may form at least a portion of the innermost surface of upper 14 or may form at least a portion of the outermost surface of upper 14. In yet other embodiments, no outer layer 28 or interior lining 30 is present on or over at least a portion of heat moldable material or sheet 32.

Heat moldable material 32 may have an outer surface 34 and an inner surface 36. In some embodiments, outer surface 34 of heat moldable material 32 may be attached to an inner surface 38 of outer layer 28, for example through bonding under heat and pressure or through stitching. In other embodiments, inner surface 36 of heat moldable material 32 may be attached to an outer surface 40 of inner lining 30, for example through bonding under heat and pressure or through stitching. In either scenario, after heat moldable material 32 is attached to either outer layer 28 or inner lining 30, outer layer 28 and inner lining 30 may be attached, for example through stitching. Alternatively, heat moldable material 32 may be attached (e.g., through bonding under heat and pressure or through stitching) to both outer layer 28 and inner lining 30 at the same time. In some embodiments, heat moldable material 32 substantially contacts outer layer 28 and/or inner lining 30. In some embodiments, for example, heat moldable material 32 substantially contacts outer layer 28 and/or inner lining 30 through direct contact of heat moldable material 32 and outer layer 28 and/or inner lining 30. In some embodiments, for example, heat moldable material 32 substantially contacts outer layer 28 and/or inner lining 30 through the use of an adhesive, or other bonding agent or attachment means.

In some embodiments, a method for making shoe 10 may comprise the steps of flat pressing heat moldable material 32 and at least one of outer layer 28 and inner lining 30 under heat and pressure to form a material package; and shaping the material package into shoe form (e.g., using conventional shoe making techniques such as lasting). In other embodiments, a method for manufacturing shoe 10 may comprise the steps of laying-up heat moldable material 32 and at least one of outer layer 28 and inner lining 30 to form a material package; and shaping the material package into shoe form (e.g., using conventional shoe making techniques such as lasting). In some embodiments, shaping the material package into shoe form includes shaping the material package over a heated last. In each of these embodiments, the method for making a shoe can further comprise the steps of heating the shoe (e.g., at a predetermined temperature for a predetermined amount of time) and inserting a wearer's foot into the shoe to allow the heat moldable material to conform to the wearer's body (e.g., a portion of a wearer's foot, ankle, lower leg, or combination thereof).

Heat moldable material or sheet 32 may be prepared for shoe making by conventional means, including, for example, by cutting from a sheet of heat moldable material. In some instances, heat moldable material 32 may be prepared by die cutting a sheet of heat moldable material.

In some embodiments, heat moldable material or sheet 32 may be located between outer layer 28 and interior lining 30 of upper 14 and may extend to overlie sole 12 of shoe 10. For example, heat moldable material or sheet 32 may extend from the shoe sides to form a plantar-surface-facing bottom that overlies sole 12 of shoe 10. In other embodiments, a strobel board may comprise a heat moldable material or sheet 32. For example, heat moldable material or sheet 32 may form a strobel board that overlies sole 12 of shoe 10.

Figure 5:
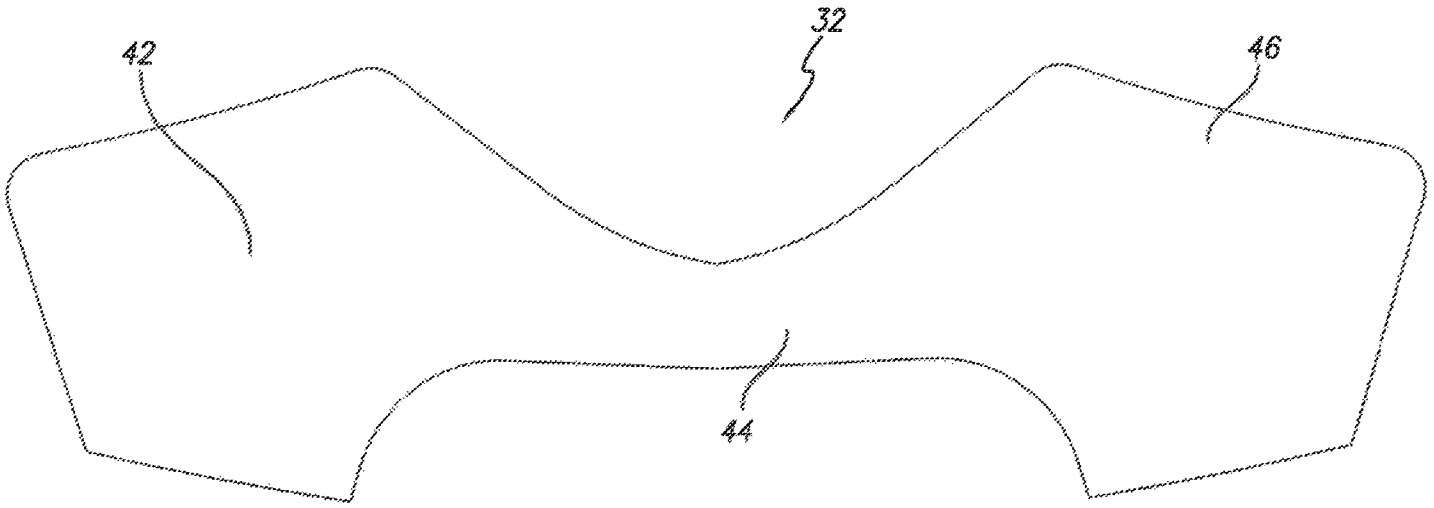
FIG. 5 is a plan view of an exemplary heat moldable material according to an embodiment of the present invention.

FIG. 5 shows an exemplary plan view of heat moldable material 32 in the form of a sheet before insertion in shoe 10. In this embodiment, heat moldable material or sheet 32 may have a lateral side region 42, a heel region 44, and a medial side region 46. FIGS. 1-3 show a dashed line illustrating an exemplary placement of heat moldable material 32 in an interior of upper 14 of shoe 10. Accordingly, lateral side region 42 of heat moldable material or sheet 32 may be located on a lateral side of shoe 10 and may extend into midfoot region 20. Similarly, medial region 46 of heat moldable material 32 may be located on a medial side of shoe 10 and may extend into midfoot region 20. Likewise, heel region 44 of heat moldable material 32 may be located in heel region 16 of shoe 10. The size and shape of heat moldable material 32 in FIG. 5 is merely exemplary and may be sized and shaped to correspond to an entire size and shape of upper 14 or to any regions of upper 14 where a customized, form-fit is desired. In some embodiments, heel region 16 of heat moldable material or sheet 32 may be sized and shaped to be located above a heel counter. In certain embodiments, the heat moldable material or sheet 32 is more flexible than a traditional heel counter. For example, the heat moldable material or sheet 32 is more flexible than a separate heel counter. Alternatively, heat moldable material or sheet 32 may extend down over the heel to take the place of a heel counter wherein at least a portion of the heat moldable material or sheet extending over the heel is stiffer, thicker, or has other different properties than the remainder of the heat moldable material or sheet. In yet another embodiment, a separate piece of heat moldable material or sheet, with heel counter properties, forms a heel counter in shoe 10.

In certain embodiments, heat moldable material or sheet 32 may be sized and shaped to be below a top of shoe 10. For example, in certain embodiments, heat moldable material or sheet 32 may be sized and shaped to be about 5 to about 10 mm below a top of shoe 10. In some embodiments, lateral side region 42 and medial side region 46 of heat moldable material may be sized and shaped to be below eyelets of shoe 10. In other embodiments, lateral side region 42 and medial side region 46 of heat moldable material may be sized and shaped to extend around the eyelets. For example, eyelets may be punched though the heat moldable material. In some embodiments, lateral side region 42 and medial side region 46 of heat moldable material may be shaped so that they do not extend into a flex area of shoe 10, such as the forefoot region 18.

Figure 6:
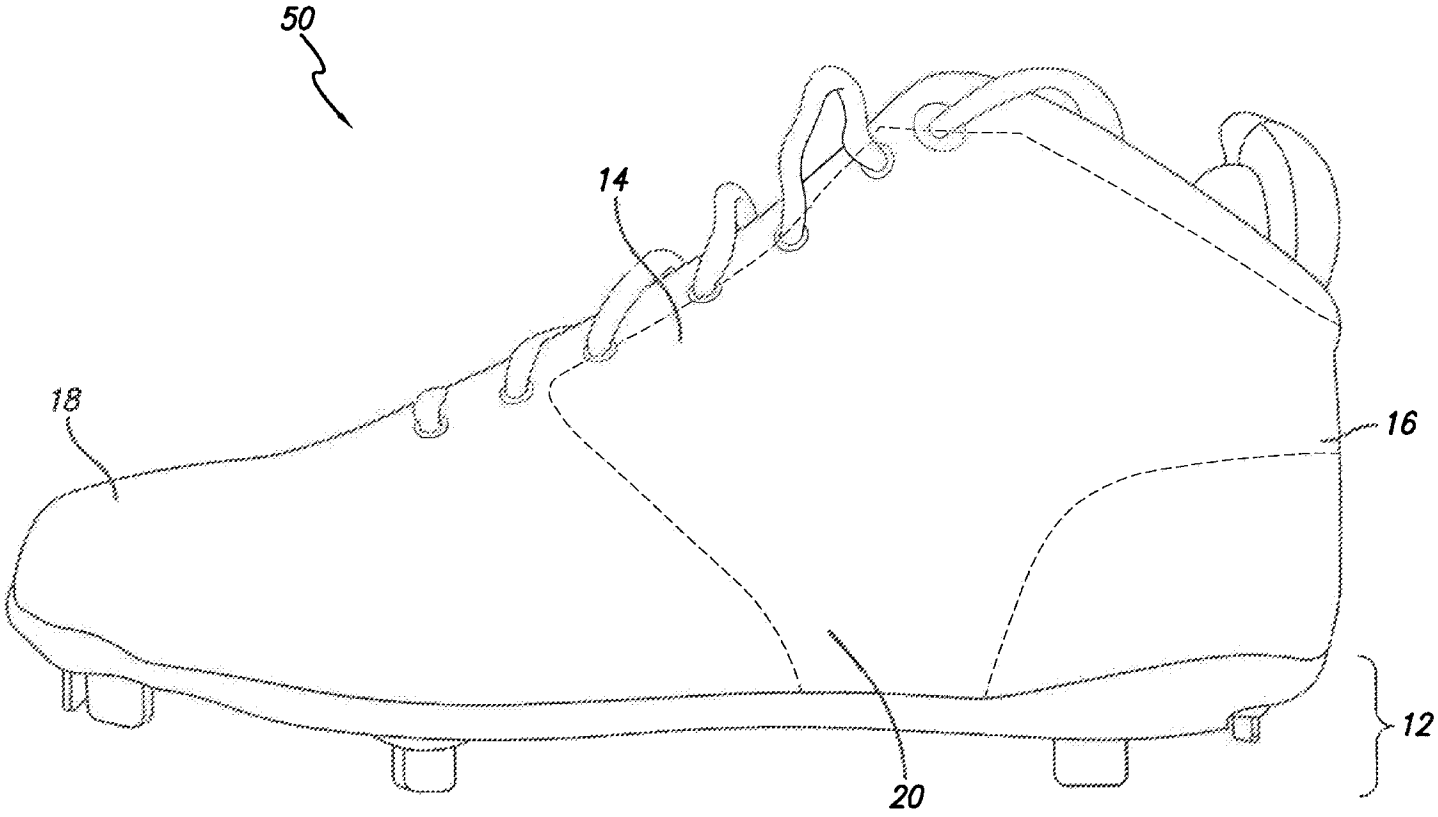
FIG. 6 is a side view of an exemplary baseball cleat according to an embodiment of the present invention.
Figure 7:
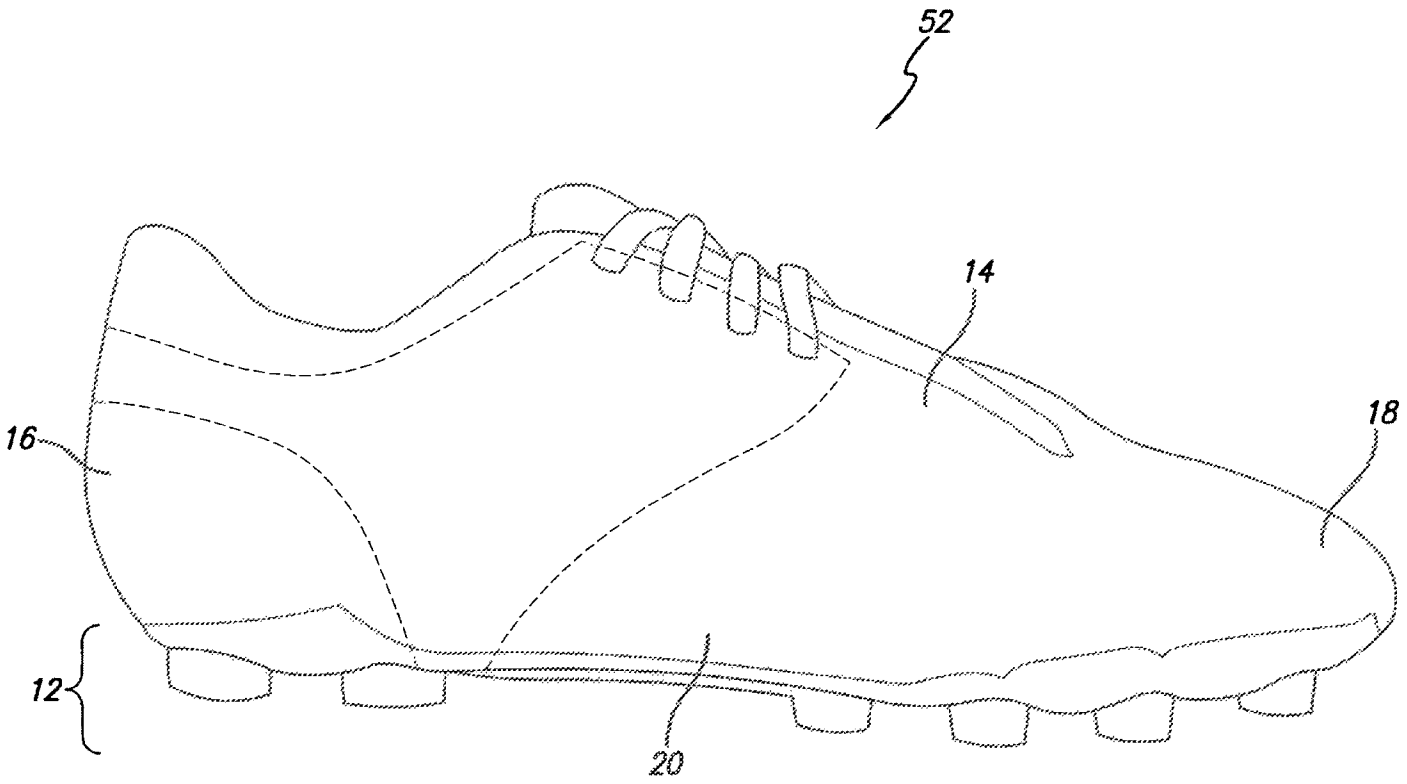
FIG. 7 is a side view of an exemplary soccer cleat according to an embodiment of the present invention.
Figure 8:
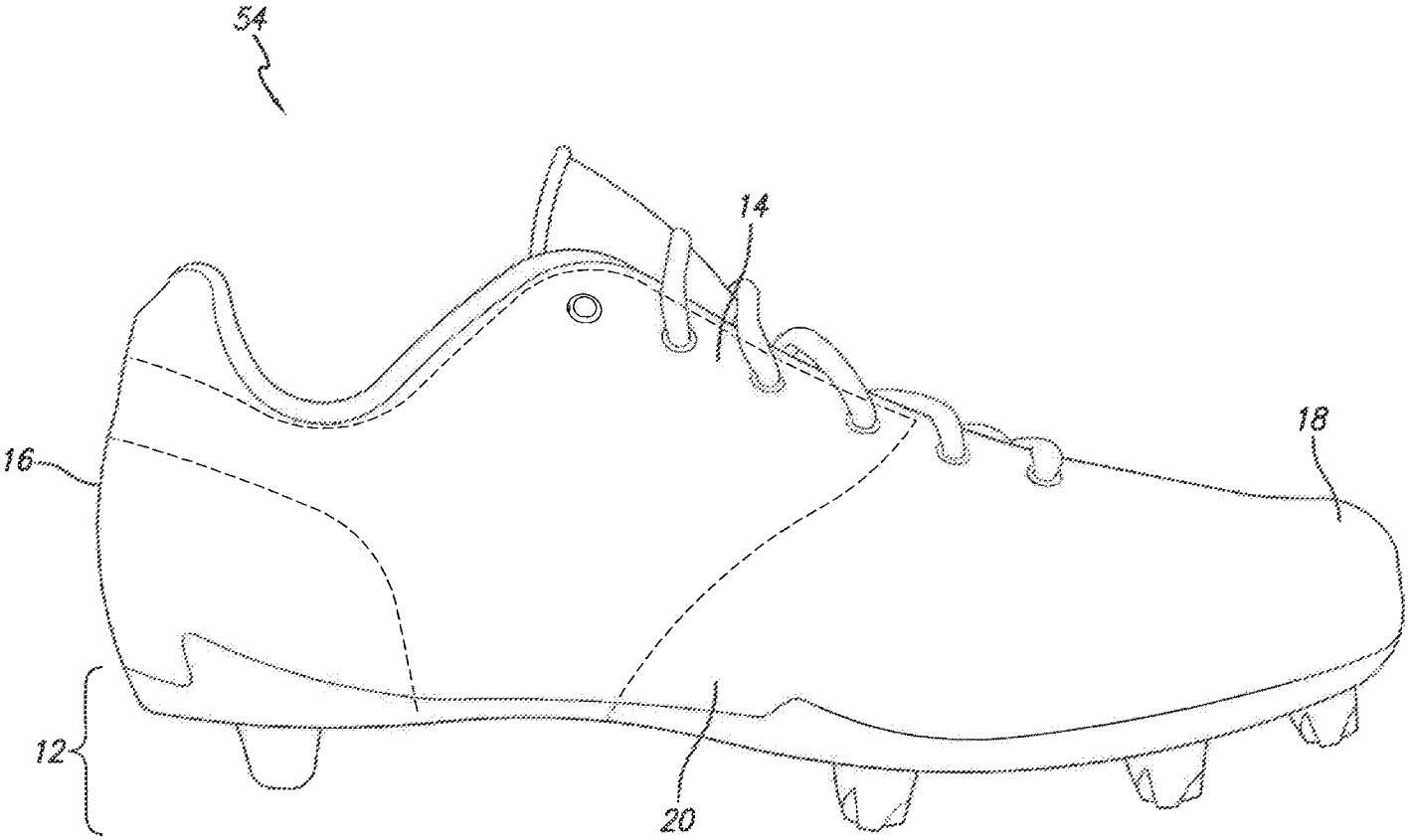
FIG. 8 is a side view of an exemplary football cleat according to an embodiment of the present invention.
Figure 9:
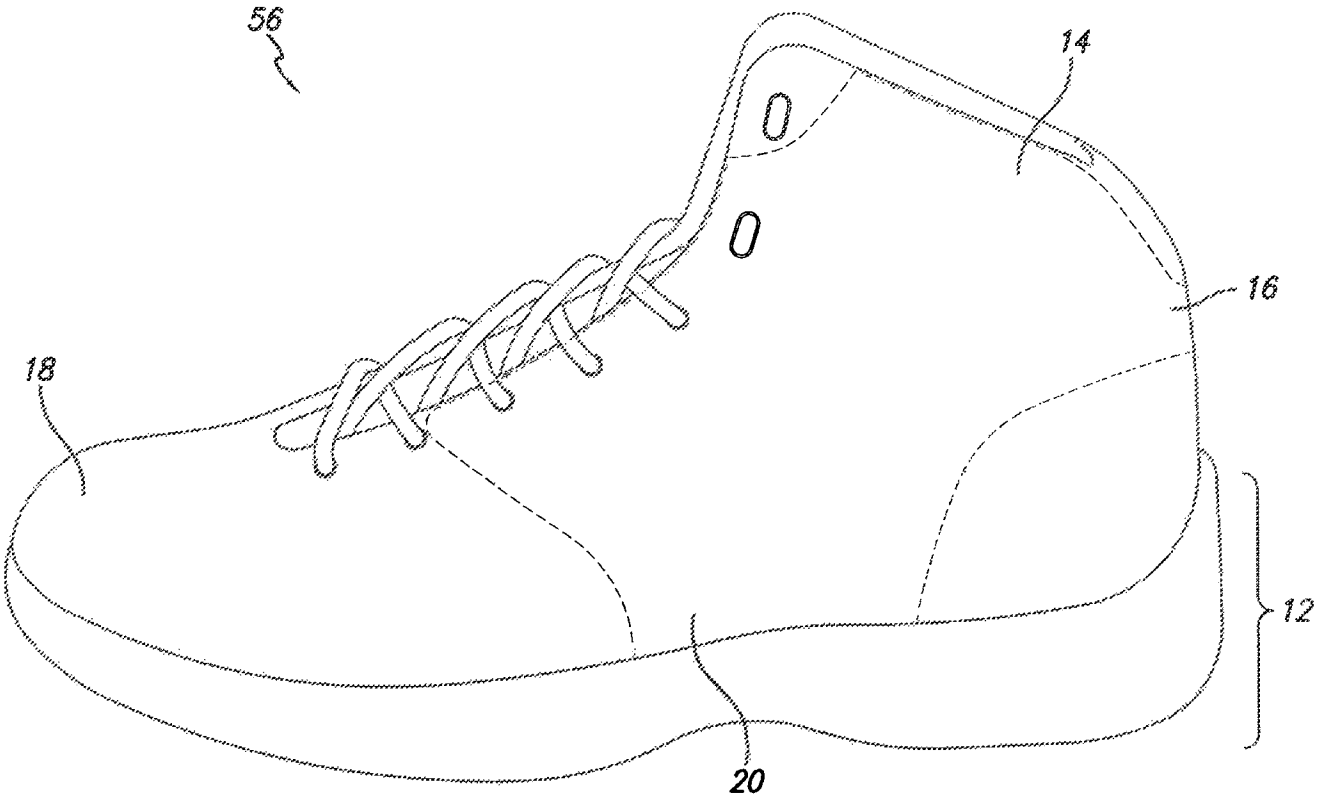
FIG. 9 is a side view of an exemplary basketball shoe according to an embodiment of the present invention.

In some embodiments, heat moldable material 32 may be sized and shaped according to the intended use of an athletic shoe. For example, FIG. 6 indicates the size and shape of heat moldable material 32 by the dashed line for an exemplary baseball cleat 50, FIG. 7 indicates the size and shape of heat moldable material 32 by the dashed line for an exemplary soccer cleat 52, FIG. 8 indicates the size and shape of heat moldable material 32 by the dashed line for an exemplary football cleat 54, and FIG. 9 indicates the size and shape of heat moldable material 32 by the dashed line for an exemplary basketball shoe 56.

In some embodiments, heat moldable material 32 may be a non-foam material, free of foam materials. In some embodiments, heat moldable material 32 may be in the form of a sheet that may include a thermoplastic resin. In some embodiments, the thermoplastic resin may be an ethylene based resin. In some embodiments, the thermoplastic resin may be a low-melt adhesive. In some instances, the thermoplastic resin may be a non-foam material. In some embodiments, the thermoplastic resin may include a layer (e.g., a top coating) of polymeric material such as, for example, urethane.

In some embodiments, heat moldable material may be in the form of a sheet that may include a thermoplastic composite. The thermoplastic composite may include a fiber component with a thermoplastic resin matrix. In some embodiments, heat moldable material 32 is not a thermoplastic composite and does not include a fiber component.

In embodiments where heat moldable material 32 is a thermoplastic composite, the fiber component of the thermoplastic composite can include, for example, continuous fiber, cut fiber (e.g., with oriented or random fiber orientation), a textile material such as a fabric (e.g., non-woven, woven, knitted, or felted material), and combinations thereof. In one specific embodiment, the fiber component of the thermoplastic composite includes a non-woven, needle-punched material. The fiber component of the thermoplastic composite can include, for example, polyester, nylon, polyamide, glass, Kevlar, or carbon fibers, and combinations thereof. In embodiments where heat moldable material 32 is a thermoplastic composite, the thermoplastic resin of the thermoplastic resin matrix may be an ethylene based resin. In some embodiments, the thermoplastic resin may be a low-melt adhesive. In some instances, the thermoplastic resin may be a non-foam material. In some embodiments, the thermoplastic composite may include a layer (e.g., a top coating) of polymeric material such as, for example, urethane. An exemplary material for a thermoplastic composite for heat moldable material 32 may be the Vantage product sold by Stanbee Company of New Jersey. Examples of suitable Vantage materials include, but are not limited to, Vantage 35 Regular, Vantage 15, Vantage 35C, and Vantage 35D. In some embodiments, the material for heat moldable material 32 may be chosen that has sufficient workability, resiliency, and shape retention to provide a customized, form-fit to a wearer when heated. It may also be desirable for heat moldable material 32 to be reusable so that it may be reheated and reshaped multiple times. This can provide the advantage of the ability to reform the heat moldable material contained in an article, such as footwear, to a different individual. This can also provide the advantage of the ability to reform the material contained in an article to a wearer's changing requirements. For example, articles of footwear containing the heat moldable material may be remolded (e.g., remolded by the consumer) to fit a growing or injured wearer. Also, articles of footwear containing the heat moldable material may be molded or remolded (e.g., molded or remolded by the consumer) to fit a user wearing braces, orthotics, bandages, or sockwear.

In some embodiments, the material for heat moldable material 32 is sufficiently flexible for use in athletic articles of footwear so that movement of the wearer is not substantially hampered by the presence of the heat moldable material. In some embodiments, heat moldable material or sheet 32 has a uniform flexibility. However, in other embodiments, heat moldable material or sheet 32 may include portions with a first flexibility and at least one portion with a second, different flexibility. In some embodiments, heat moldable material 32 may have an initial collapsing load of less than about 130 Newtons (N). For example, heat moldable material 32 can have an initial collapsing load of less than about 80 N such as about 25 to about 80 N, about 40 N to about 60 N, or about 50 N to about 60 N. Initial collapsing load can be measured using the SATRA TM 83 1996 test method. In some embodiments, heat moldable material 32 may have a resilience of at least about 25%, at least about 30%, at least about 40%, at least about 50%, at least about 60%, or at least about 70%. Resilience can be measured as percentage retention of initial collapsing load after a given number of collapses (e.g., ten collapses).

It is also important to consider various properties of heat moldable material 32, such as the activation temperature, the open time, the stiffness, and the thickness. The material activation temperature may be the temperature at which heat moldable material 32 softens so that it may be molded to conform to the contour of a wearer's anatomy. The material activation temperature of the heat moldable material is important because it should not be so high that other portions of shoe 10 will be burned or damaged when heating shoe 10 and heat moldable material 32 to the material activation temperature. In some embodiments, the material activation temperature of heat moldable material 32 may be in a range between about 120 and about 220 degrees Fahrenheit (F), between about 125 and about 200 degrees F., between about 130 and about 175 degrees F., or between about 130 and about 150 degrees F.

The ambient air activation temperature may be the temperature of surrounding air at which heat moldable material 32 softens so that it may be molded to conform to the contour of a wearer's anatomy. The ambient air activation temperature of the heat moldable material should not be so high that other portions of shoe 10 will be burned or damaged when heating shoe 10 and heat moldable material 32. In some embodiments, the ambient air activation temperature may be in a range between about 120 and 220 degrees F., between about 130 and 210 degrees F., between about 150 and 200 degrees F., between about 160 and 190 degrees F., or between about 165 and about 180 degrees F.

The open time of heat moldable material 32 may be a measurement of how long heat moldable material 32 is moldable after being removed from a heat source. In other words, a wearer's foot must be inserted in shoe 10 and conformed around the wearer's anatomy before the open time of heat moldable material 32 elapses in order to obtain a customized, form-fit. In some embodiments, the open time may be at least about 30 seconds, at least about 1 minute, at least about 2 minutes, at least about 3 minutes, or at least about 5 minutes. In other embodiments, the open time may be in a range between about 1 and about 10 minutes, about 1 and about 5 minutes, or about 2 and about 3 minutes.

The thickness of heat moldable material 32 is one factor in the flexibility of the heat moldable material 32 and whether it is suitable for use in an athletic shoe. In some embodiments, heat moldable material 32 may be a thin sheet. The thin sheet may have a uniform thickness or may have a non-uniform thickness. In some embodiments, the heat moldable material may include areas of greater thickness and areas of lesser thickness. For example, in some embodiments, a sheet of heat moldable material may include ridges or ribs of heat moldable material having a greater thickness and areas of heat moldable material adjacent to such ridges or ribs that have a lesser thickness. In some embodiments, a sheet of heat moldable material may include ridges or ribs in areas of the sheet, for example, where increased stiffness is desired. In some embodiments, since areas of a sheet having different thicknesses may soften at different rates, a sheet of heat moldable material having varying thickness may be used when a variation in the moldability of the sheet is desired. One method of making a sheet of heat moldable material having a variable thickness or an increased thickness can include the step of joining pieces of heat moldable materials (e.g., sheets, strips, shapes, or combinations thereof) face-to-face to form the sheet of heat moldable material. Such a method can also include the step of permanently or temporarily bonding or stitching the pieces of heat moldable materials together.

In some embodiments, the maximum thickness of heat moldable material or sheet 32 is less than about 2 mm, less than about 1.5 mm, or less than about 1 mm. In some embodiments, the maximum thickness of heat moldable material 32 may be in a range between about 0.35 and 0.95 mm, about 0.40 and 0.90 mm, about 0.45 and 0.85 mm, about 0.50 and 0.80 mm, about 0.55 and 0.75 mm, about 0.60 and 0.70 mm, or about 0.65 mm. In some embodiments, the average thickness of heat moldable material or sheet 32 is less than about 2 mm, less than about 1.5 mm, or less than about 1 mm, for example, between about 0.3 and about 1 mm or between about 0.5 and about 0.75 mm.

The size and shape of heat moldable material 32 is another factor in the flexibility of the heat moldable material 32 and whether it is suitable for use in an athletic shoe. In some instances, heat moldable material 32 is a continuous sheet of heat moldable material. In other embodiments, heat moldable material 32 can include cut-outs, cut-ins, perforations, slits, or combinations thereof. For example, heat moldable material 32 can include cut-out or cut-in shapes (e.g., rectangular, square, triangular, circular, elliptical, or irregular cut-outs or cut-ins). Such cut-outs, cut-ins, perforations, or slits can permit heat moldable material 32 to flex more easily. In some embodiments, cut-outs, cut-ins, perforations, or slits can provide ventilation or liquid wicking through heat moldable material 32.

Table 1 below shows exemplary samples of Vantage product sold by Stanbee Company of New Jersey suitable for heat moldable material 32. As can be seen below, Samples A, C, and D have similar thickness ranges, but varying open times. The amount of thermoplastic resin varied between the Samples A, C, and D with Sample A having the highest amount of thermoplastic resin and Sample D having the lowest amount of thermoplastic resin. Sample A has the highest flexibility and the longest open time and Sample D has the lowest flexibility and the shortest open time. Sample B is similar to Sample A, except it has a lesser thickness.

TABLE 1

| | Sample A | Sample B | Sample C | Sample D |
|---|---|---|---|---|
| Ambient Air Activation Temperature Range (° F.) | 167-176 | 167-176 | 176 | 176-185 |
| Open time (seconds) | 210 | 165-180 | 90 | 20 |
| Thickness Range (mm) | 0.838-0.94 | 0.368-0.432 | 0.838-0.94 | 0.838-0.94 |

As noted above, shoe 10 may include a temperature sensitive indicator 26. Temperature sensitive indicator 26 may be used in facilitating a method of customizing and form-fitting shoe 10 to the foot of a wearer as it may have a visible change when a predetermined temperature, such as the activation temperature of heat moldable material 32, is reached. In some embodiments, the visible change may be a change in color. Temperature sensitive indicator 26 may include a substrate coated in a temperature sensitive ink that changes color at different temperatures and enclosed in a transparent dome. Such a temperature sensitive indicator 26 may be obtained from Rongyuan Company in Fuzhou China. Suitable temperature sensitive ink may be Heat Discoloration Ink, Part Nos. 6C, 072C, 102C, and/or 1935C available from Shenzhen JieLi Anti-Counterfeiting Technology Co., Ltd. in China. In some embodiments, the entire substrate may be coated or the ink may be coated on the substrate in a pattern, such as in the form of an indicium, logo, letter, or word. In some embodiments, the temperature sensitive ink may be colorless at room temperature and may change colors as the temperature rises. In other embodiments, the temperature sensitive ink may be one color at room temperature and may change colors as the temperature rises. The temperature sensitive ink may only change colors once, or may change colors multiple times. For example, temperature sensitive indicator 26 may have a first color change when an activation temperature of the heat moldable material is reached so that a wearer knows that shoe 10 is ready for customized fitting. In some embodiments, temperature sensitive indicator 26 may have additional color changes that may indicate shoe 10 is too hot to touch or that shoe 10 has sufficiently cooled such that heat moldable material 32 is not at a temperature that corresponds to a moldable state. For example, in one embodiment temperature sensitive indicator 26 may be a first color at room temperature, may be a second color between room temperature and an activation temperature of heat moldable material 26 and a third color at an activation temperature of heat moldable material 26. Thus, a wearer may know shoe 10 is ready for customizing and form-fitting when temperature sensitive indicator 26 is the third color, may know that the open time for heat moldable material 32 has elapsed when indicator 26 is the second color, and may know that molding of heat moldable material 32 is complete when indicator 26 is the first color. In some embodiments, when temperature sensitive indicator 26 has multiple color changes, each color change may be caused by a different temperature sensitive ink. In some instances, temperature sensitive indicator 26 may be sectioned off so that each section has a different temperature sensitive ink.

In some embodiments, temperature sensitive indicator 26 may be attached to upper 14. For example, temperature sensitive indicator 26 may be attached to an exterior surface of flexible outer layer 28 of upper 14 or may be located in a cavity of flexible outer layer 28 and covered with a transparent material. In other embodiments, temperature sensitive indicator 26 may be attached to sole 12. For example, temperature sensitive indicator 26 may be attached to an exterior surface of sole 12 or may be located in a cavity of sole 12. In some embodiments, temperature sensitive indicator 26 is in direct contact with heat moldable material 32. In other embodiments, temperature sensitive indicator 26 is not in direct contact with heat moldable material 32. In some embodiments, temperature sensitive indicator 26 is permanently attached to shoe 10.

While temperature sensitive indicator 26 is described above as having a visible color change, temperature sensitive indicator 26 may indicate a change in temperature in other manners as an alternative to a visible color change or in combination therewith. For example, temperature sensitive indicator 26 may have a tactile change or an audible signal in different temperature regimes. In some embodiments, temperature sensitive indicator 26 can undergo a change in configuration to indicate a change in temperature. For example, in one embodiment, temperature sensitive indicator 26 includes a liquid crystal device that can indicate a change in temperature. Such liquid crystal devices can be obtained, for example, from LCR Hallcrest (Glenview, Ill.).

Figure 10:
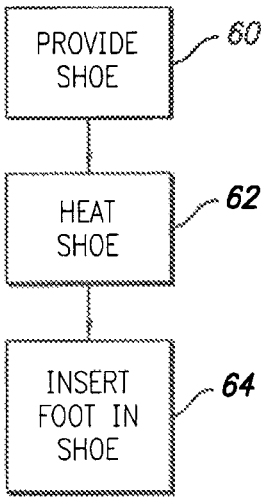
FIG. 10 is a flowchart illustrating an exemplary method of providing a customized, form-fitted article of footwear.

An exemplary method for providing a customized form-fit for a shoe for a wearer will be described in combination with the exemplary flowchart of FIG. 10. The method of FIG. 10 may include a step 60 of providing a shoe, such as shoe 10 described above, with reference to FIGS. 1-4. The method may also include a step 62 of heating shoe 10 to a predetermined temperature, at a predetermined temperature for a predetermined amount of time, or at a predetermined temperature, following which heat moldable material 32 is softened to permit molding. Subsequently, the method may also include a step 64 of inserting a wearer's foot in shoe 10 after heating step 62 to provide a customized form-fit of shoe 10 to the wearer.

Step 60 of providing a shoe may include providing an athletic shoe, such as shoe 10, described above with reference to FIGS. 1-4. Shoe 10 may or may not have temperature sensitive indicator 26.

Step 62 may include heating shoe 10 at a predetermined temperature for a predetermined amount of time, heating shoe 10 at a predetermined temperature, or heating shoe 10 to a predetermined temperature. Heating may be accomplished by placing shoe 10 in a heat source (e.g., in a convection oven, conventional oven, solar oven, or microwave oven), by placing shoe 10 near or in the path of a heat source (e.g., by using a heat gun, a hair dryer, a heat lamp, or sunlight), by incorporating a heat source within shoe 10 (e.g., a chemical heat source or an electrical resistance heat source located within the shoe such as a battery-operated electrical resistance heat source), or by placing a heat source into shoe 10. In some embodiments, the heat source may be preheated to the desired temperature prior to placing shoe 10 in or near the heat source. Alternatively, in other embodiments, shoe 10 may be inside or near the heat source while it is heating.

The predetermined temperature to which shoe 10 is heated may refer to, for example, the surface temperature of the shoe, the internal temperature of the shoe, or the temperature of the heat moldable material. The predetermined temperature at which shoe 10 is heated may refer to, for example, an oven temperature, an ambient air temperature, or the temperature of a heat source. In some embodiments, the predetermined temperature for heating shoe 10 or to which shoe 10 is heated may be in a range between about 120 and about 250 degrees F., between about 130 and about 210 degrees F., between about 150 and about 200 degrees F., between about 160 and about 190 degrees F., or between about 165 and about 180 degrees F. In some embodiments, shoe 10 may be heated to a predetermined temperature (e.g., a shoe surface temperature) in a range between about 120 and about 220 degrees F. such as between about 120 and about 140 degrees F. or about 125 and about 130 degrees F. In some embodiments, the predetermined time duration for which shoe 10 is heated may be between about 1 and about 15 minutes, about 1 and about 5 minutes, about 2 and about 4 minutes, or about 3.5 minutes. In some embodiments, shoe 10 may be heated in an about 200 degree F. oven for between about 1 and about 15 minutes, about 1 and about 5, about 2 and about 4 minutes, or about 3.5 minutes. In one specific embodiment, shoe 10 may be heated in an about 200 degree F. oven for about 3.5 minutes. These parameters are merely exemplary and may be modified as needed based, for example, upon the physical properties of heat moldable material 32, the size and shape of shoe 10, the configuration of heat moldable material 32 within shoe 10, and the choice of heat source.

In some embodiments, shoe 10 may have temperature sensitive indicator 26 discussed above. In place of, or in combination with, heating for a predetermined time or heating at a predetermined temperature, shoe 10 may be heated until temperature sensitive indicator 26 has a particular visible change, such as a color change, that indicates shoe 10 has been sufficiently heated to soften heat moldable material 32 so that it will conform to the contours of a wearer's foot.

In step 64, once the shoe 10 has been heated for the predetermined time, to the predetermined temperature, and/or until temperature sensitive indicator 26, if present, indicates shoe 10 has reached a desired temperature, shoe 10 may be removed from the heat source. A wearer may then insert their foot into shoe 10. It is important that wearer insert their foot into shoe 10 during the open time of the heat moldable material. As discussed above, the open time may be a measurement of how long heat moldable material 32 is moldable after being removed from a heat source. Heat moldable material 32 is sufficiently softened so that it may mold to the contour of the wearer's foot, ankle, or lower leg to provide a customized form-fit of shoe 10 for the wearer. A wearer's foot may be kept in shoe 10 for providing the customized form-fit for a sufficient time for heat moldable material 32 to cool and retain the shape customized to the contour of the wearer's foot, ankle, or lower leg. In some embodiments, shoe 10 may be fastened, (e.g., via laces or straps) once it has been placed on the wearer. In some preferred embodiments, shoe 10 may be tightly fastened (e.g., via laces or straps) once it has been placed on the wearer.

In some embodiments, the wearer's foot may be kept in shoe 10 for at least about 30 seconds, at least about 1 minute, at least about 2 minutes, at least about 3 minutes, or at least about 5 minutes. In some instances, the wearer's foot may be kept in shoe 10 for a duration in a range between about 1 and about 20 minutes, such as about 1 to about 15 minutes, about 1 to about 10 minutes, or about 5 to about 10 minutes. In some embodiments, when temperature sensitive indicator 26 is present, temperature sensitive indicator 26 may indicate when a wearer may remove their foot from shoe 10, such as by a visible change, such as a change in color.

In some embodiments, as discussed above, heat moldable material 32 may be reusable, meaning it may be reheated and remolded multiple times. This permits the process of FIG. 10 to be performed multiple times or as often as necessary.

The present invention also includes an insole or sockliner comprising a heat moldable material or sheet. In some embodiments, an insole may include a heat moldable material or sheet and an overlying sockliner. For example, a sockliner may directly overlie a heat moldable material or sheet. In other embodiments, a sockliner itself can be formed of a heat moldable material or sheet. In some instances, the heat moldable material or sheet can be located only in selected portions of the insole or sockliner. In other instances, the heat moldable material or sheet can be located across the entire width and length of the insole or sockliner.

While many of the embodiments described herein make reference to shoe 10 and fitting such shoe to a wearer's foot, ankle, or lower leg, in other embodiments sporting equipment (e.g., helmets, helmet liners, chest protectors, arm protectors, rib pads, shin guards, spats, baseball gloves, goalie gloves, etc.) or articles of clothing (e.g., gloves, hats, etc.) may contain heat moldable material and be fitted to a wearer's anatomy. For example, in some embodiments, a piece of sporting equipment or an article of clothing may comprise a heat moldable material. In some embodiments, the piece of sporting equipment or article of clothing may further include a lining, covering, padding, or combination thereof underlying or overlying the heat moldable material. In some embodiments, the piece of sporting equipment or the article of clothing may include a temperature sensitive indicator.

Figure 11:
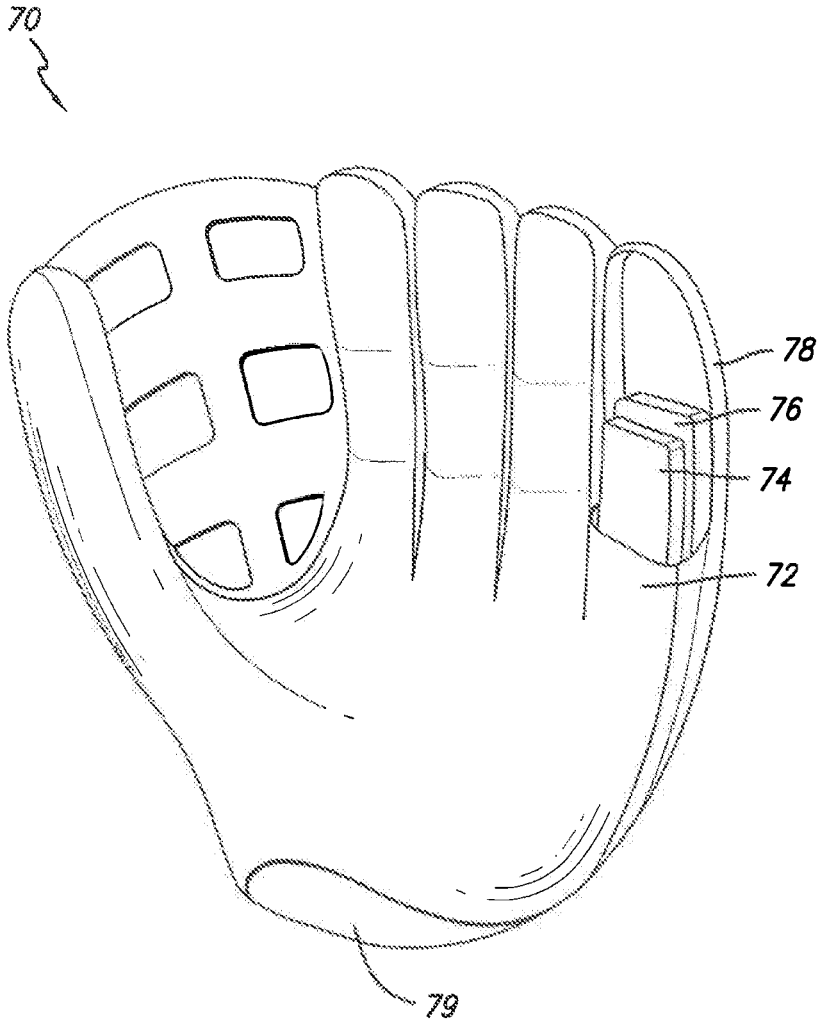
FIG. 11 is an exemplary glove with a partial cut-away view according to an embodiment of the present invention.
Figure 12:
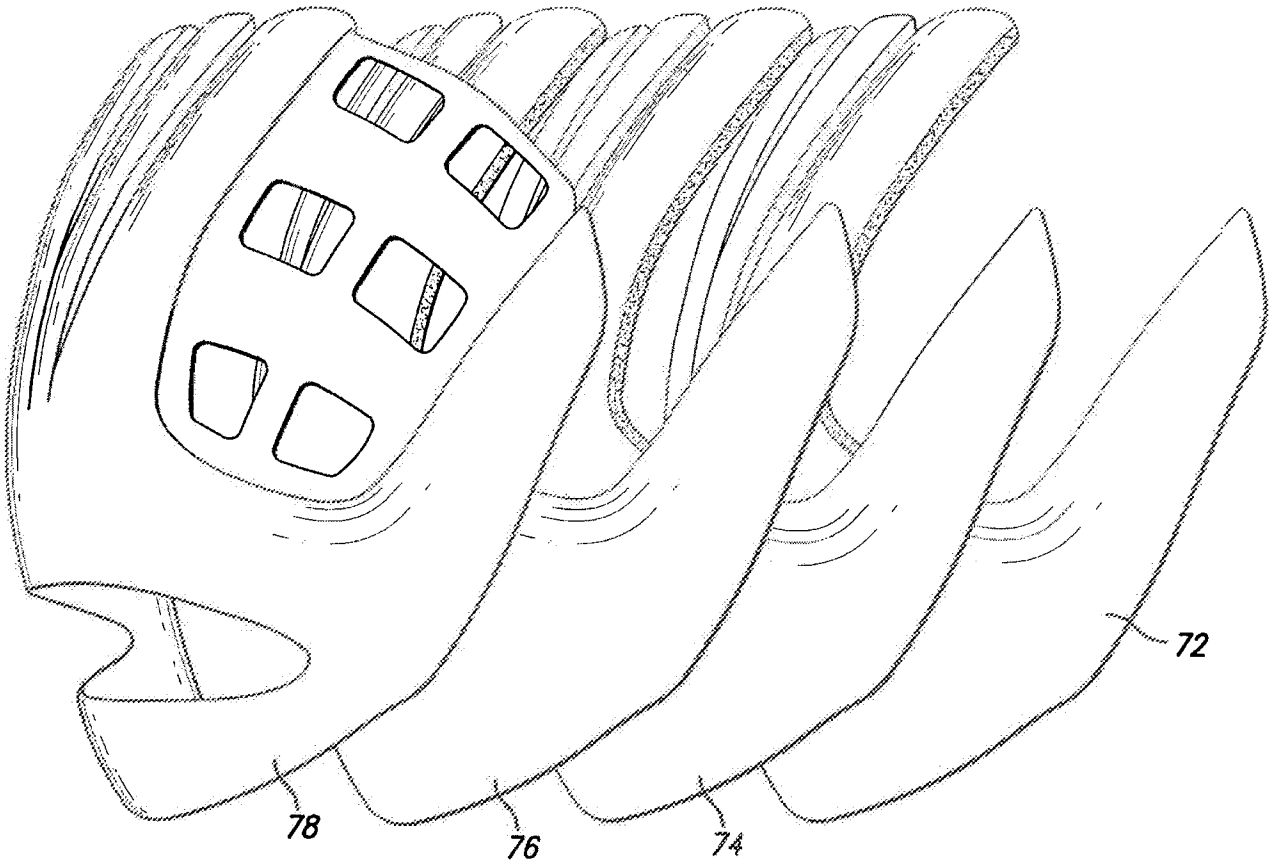
FIG. 12 is an exploded view of the exemplary glove of FIG. 11 according to an embodiment of the present invention.

In some embodiments, as shown for example in FIGS. 11 and 12, the customized form-fitted article may be a glove 70, for example a baseball or softball glove, or a goalie's glove for hockey, lacrosse, or field hockey. Glove 70 may have a layered construction from front to back including a first or front outer layer 72, a filler layer 74, a heat moldable material layer 76, and a second or back outer layer 78. First and second outer layers 72 and 78 may be any material typically utilized for gloves, such as leather or synthetic material. First and second outer layer 72 and 78 may be attached around their peripheries, with filler layer 74 and heat moldable material layer 76 located therebetween, using conventional means, such as stitching.

The material for filler layer 74 may have a cushioning effect to minimize the impact of a ball or puck against glove 70. Filler layer 74 and heat moldable material layer 76 may be adhered, laminated, stitched or otherwise joined together to prevent relative movement within glove 70. Further, the joined together filler layer 74 and heat moldable material layer 76 may be adhered, laminated, stitched or otherwise joined to first outer layer 72 and/or second outer layer 78.

Heat moldable material layer 76 may be flexible to ensure adequate movement of the fingers and hand of the wearer. Heat moldable material layer 76 may be similar to heat moldable material 32 discussed above with reference to shoe 10, and therefore has not been described again in great detail. Heat moldable material layer 76 may be shaped to be placed inside the entirety of glove 70. In other embodiments, heat moldable material layer 76 may be present in only a portion of glove 70, for example only in the fingers, in a webbed portion between fingers, in the palm area, or in a combination thereof.

Figure 15:
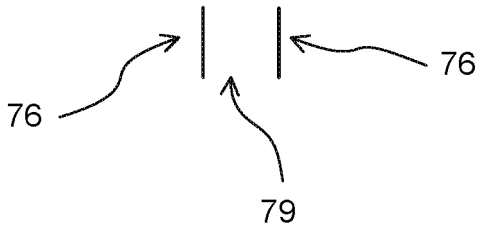
FIG. 15 is a schematic representation of a portion of a glove according to an embodiment of the present invention.

Glove 70 may have an opening 79 for receiving a wearer's hand. In some embodiments opening 79 may be positioned such that the wearer's hand is inserted into glove 70 between second outer layer 78 and heat moldable material layer 76. However, in other embodiments opening 79 may be positioned such that the wearer's hand is inserted into glove 70 between heat moldable material layer 76 and fill layer 74. In some embodiments there may be two heat moldable material layers 76 such that opening 79 may be positioned such that the wearer's hand may be inserted into glove 70 between the two heat moldable material layers 76 as shown schematically in FIG. 15, In some embodiments, heat moldable material layers 76 or fill layer 74 may be covered with a layer of additional, hand-contacting material (e.g., fabric, foam, leather, etc.). Glove 70 may be heated at a predetermined temperature for a predetermined time and they the user's hand may be inserted into glove 70 to provide a customized form fit. In some instances, glove 70 may be heated (e.g., at a predetermined temperature for a predetermined time) and then an object (e.g., a puck, ball or first) may be held with glove 70 to provide a user customized space foe such object. Thus, practice of the present invention can provide a custom catching pocket for glove 70 whereby a wearer can tailor a catching pocket suited to their preference or style of play. For example, in a baseball glove with a webbed portion between the thumb and index finger, heat moldable material can be present in the thumb area, the index finger area, the webbed area, or a combination thereof and glove 70 may be heated (e.g., at a predetermined temperature for a predetermined time) and a custom pocket for a ball formed therein.

An exemplary method for providing a customized form fit for glove 70 to a wearer's hand may include providing a glove 70 having a flexible heat moldable material layer 76 configured to conform to a wearer's hand when heated to a predetermined temperature to provide the wearer with a customized fit for the glove. In some embodiments, flexible heat moldable layer 76 may include a fabric and a thermoplastic resin. In some embodiments, flexible heat moldable layer 76 may include a thermoplastic resin and does not include a fabric. In some embodiments, the method for providing a customized form fit for glove 70 to a wearer's hand may correspond to the method discussed above with reference to shoe 10 and FIG. 10, and therefore has not been described in great detail again. Glove 70 may also have a temperature sensitive indicator (not shown) similar to temperature sensitive indicator 26 for use in customizing and form-fitting an article as discussed above with reference to shoe 10, and therefore has not been described again.

Figure 13:
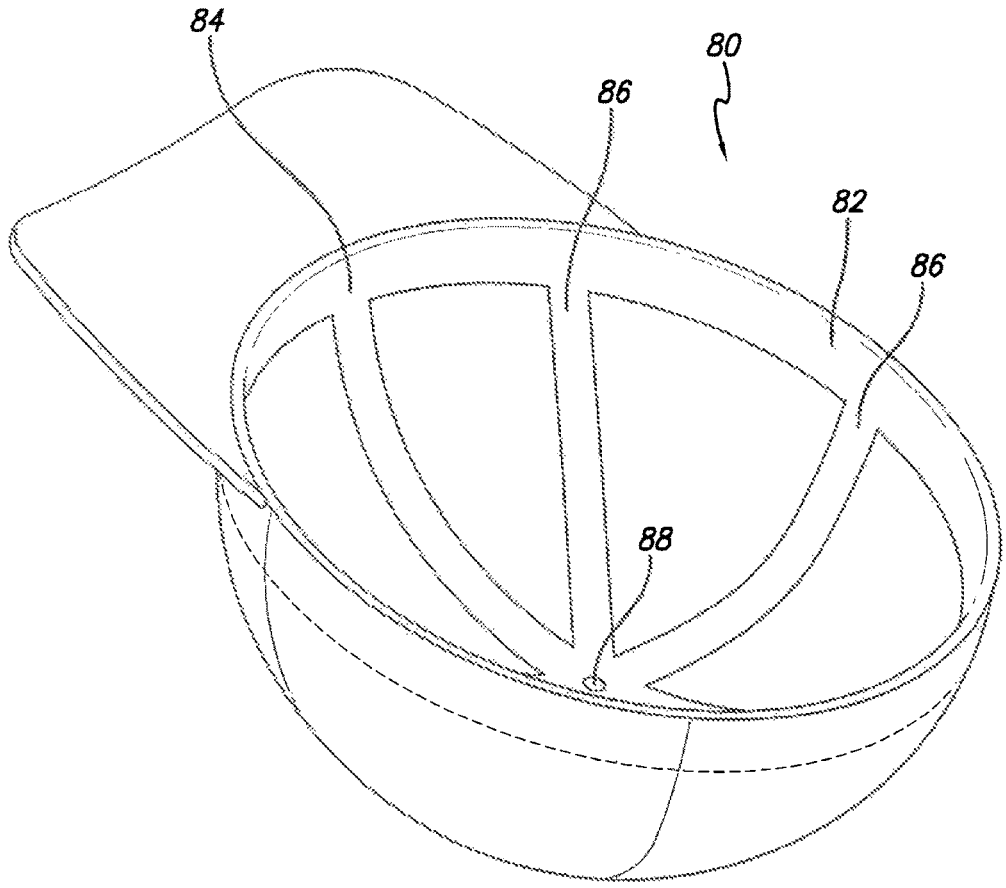
FIG. 13 is a bottom perspective view of an exemplary hat according to an embodiment of the present invention.
Figure 14:
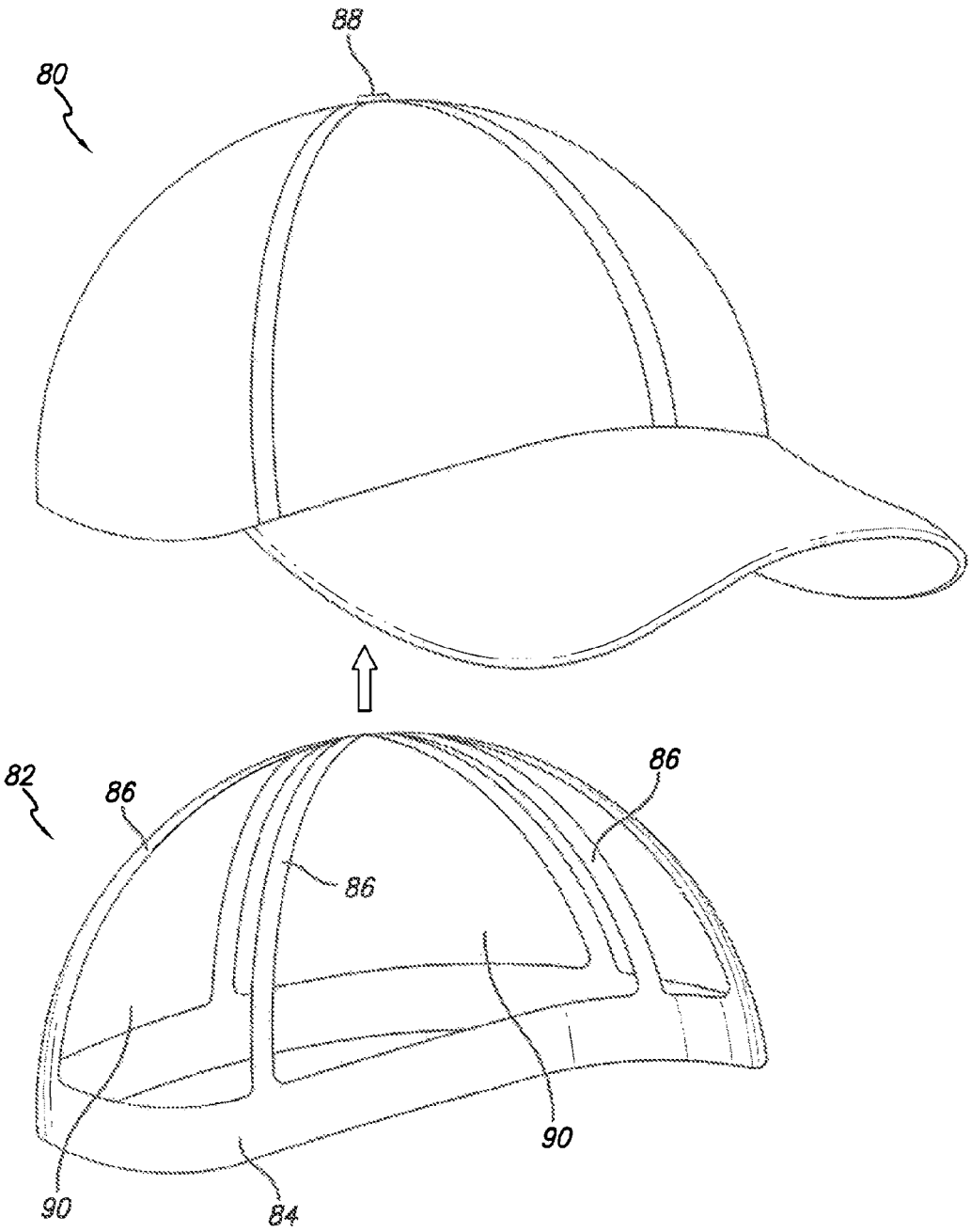
FIG. 14 is an exploded view of the exemplary hat of FIG. 13 according to an embodiment of the present invention.

In some embodiments, as shown for example in FIGS. 13 and 14, the customized form-fitted article may be an article of headwear 80 such as a hat, for example a baseball cap. Although the article of headwear 80 may be referred to herein as hat 80, it is contemplated that it may comprise any type of headgear in which the customized, form-fitting feature of the present invention may be desirable, including, but not limited to a baseball or softball batting helmet, a helmet with a mask, such as for football, hockey, or lacrosse, or a helmet without a visor such as for bikes or motorcycles.

Hat 80 may include a heat moldable material 82 attached to an interior of hat 80 to provide a hat that may be customized and form-fitted to the contour of the head of a wearer. Heat moldable material 82 may be attached to the interior of hat 80 through conventional means, for example by stitching, adhering or laminating. Heat moldable material 82 may be similar to heat moldable material 32 discussed above with reference to shoe 10, and therefore has not been described again in great detail. In some embodiments, hat 80 may also include an interior lining that overlies heat moldable material 32.

In some embodiments, as shown for example in FIGS. 13 and 14, heat moldable material 82 may be substantially hemispherical in shape and may have a substantially circular rim 84 with a plurality of strips 86 extending from rim 84 and joining at a topmost point of the hemisphere, which may correspond to a topmost point 88 of hat 80. In some embodiments, as shown in FIGS. 13 and 14, there may be six strips 86 with gaps 90 that are void of material in between adjacent strips 86. However, the number of strips may be varied. In some instances, heat moldable material 82 may include rim 84, with no strips 86 present. In other embodiments, heat moldable material 82 may include strips 86, with no rim 84 present. In other embodiments, heat moldable material 82 may be a hollow hemisphere in shape such that there are no strips 86 and no gaps 90. In some embodiments, heat moldable material 82 may have slits, perforations, cut-ins, or cutouts present for breathability or flexibility. In some embodiments, hat 80 may include heat moldable material 82 located within the brim of the hat to permit customized molding of the brim by the wearer.

An exemplary method for providing a customized form fit for hat 80 to a wearer's head may include providing a hat 80 having a heat moldable material 82 configured to conform to a wearer's head when heated to a predetermined temperature to provide the wearer with a customized fit for the hat. In some embodiments, heat moldable material 82 may include a fabric and a thermoplastic resin. In some embodiments, heat moldable material 82 may include a thermoplastic resin and does not include a fabric. In some embodiments, the method for providing a customized form fit for hat 80 to a wearer's head may correspond to the method discussed above with reference to shoe 10 and FIG. 10, and therefore has not been described in great detail again. Hat 80 may also have a temperature sensitive indicator (not shown) similar to temperature sensitive indicator 26 for use in customizing and form fitting an article as discussed above with reference to shoe 10, and therefore has not been described again.

Thus, a customized, form-fitting article, such as an athletic shoe, glove, or hat, may include a heat moldable material that conforms to the wearer's anatomy when heated to a predetermined temperature to provide a customized, form-fit is presented. The heat moldable material may be sufficiently flexible for use in athletic shoes so that movement of the foot or shoe is not hampered by the presence of the heat moldable material. The heat moldable material may also be reusable, so that it may be reheated and remolded multiple times.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An athletic glove, comprising: a front outer layer having a periphery and a back outer layer having a periphery, wherein the front outer layer and the back outer layer are attached about a portion of their peripheries and define an opening for receiving a hand, a plurality of finger portions, and a palm area; a filler layer disposed between the front outer layer and the back outer layer, wherein the filler layer is disposed in the palm area and is in direct contact with the front outer layer or the back outer layer in the palm area; a flexible heat moldable sheet disposed between the front outer layer and the back outer layer; and a temperature sensitive indicator configured to undergo a visible change when the predetermined temperature is reached, wherein the temperature sensitive indicator is disposed directly on an outer surface of the front outer layer or an outer surface of the back outer layer;

wherein the flexible heat moldable sheet is configured to conform to at least a portion of a wearer's hand when heated to the predetermined temperature to provide the wearer with a customized fit for the athletic glove, and wherein the flexible heat moldable sheet comprises a fabric and a thermoplastic resin.

2. The athletic glove of claim 1, wherein the filler layer is attached to the flexible heat moldable sheet.

3. The athletic glove of claim 1, comprising a glove selected from the group consisting of: a baseball glove, a softball glove, a hockey glove, a lacrosse glove, and a field hockey glove.

4. The athletic glove of claim 1, wherein the flexible heat moldable sheet is disposed in the plurality of finger portions and the palm area.

5. The athletic glove of claim 1, wherein the flexible heat moldable sheet is disposed in the palm area.

6. The athletic glove of claim 1, wherein the predetermined temperature is in a range from about 120 degrees Fahrenheit to about 220 degrees Fahrenheit.

7. The athletic glove of claim 1, wherein the predetermined temperature is in a range from about 120 degrees Fahrenheit to about 140 degrees Fahrenheit.

8. The athletic glove of claim 1, wherein the thermoplastic resin comprises an ethylene based resin.

9. The athletic glove of claim 1, wherein the flexible heat moldable sheet further comprises a polyurethane coating.

10. The athletic glove of claim 1, wherein the flexible heat moldable sheet is a non-foam material.

11. The athletic glove of claim 1, wherein the fabric comprises a woven fabric.

12. The athletic glove of claim 1, wherein when heated the flexible heat moldable sheet is configured to conform to the wearer's palm area.

13. The athletic glove of claim 1, wherein when heated the flexible heat moldable sheet is configured to conform to one or more of the wearer's fingers.

14. The athletic glove of claim 1, wherein when heated the flexible heat moldable sheet is configured to conform to a piece of sports equipment selected from the group consisting of: a ball and a puck.

15. The athletic, glove of claim 1, wherein the back outer layer and the flexible heat moldable sheet are disposed such that the wearer's hand is to be inserted into the glove intermediate to the back outer layer and the flexible heat moldable sheet.

16. The athletic glove of claim 1, wherein the filler layer and the flexible heat moldable sheet are disposed such that the wearer's hand is to be inserted into the glove intermediate to the filler layer and the flexible heat moldable sheet.

17. The athletic glove of claim 1, wherein the flexible heat moldable sheet is disposed in a web portion of the glove.

18. The athletic glove of claim 1, wherein the flexible heat moldable sheet defines a surface of a hand cavity within the athletic glove.

19. An athletic glove, comprising: a front outer layer having a periphery and a back outer layer having a periphery, wherein the front outer layer and the back outer layer are attached about a portion of their peripheries and define an opening for receiving a hand, a plurality of finger portions, and a palm area;

a first flexible heat moldable sheet disposed between the front outer layer and the back outer layer; a second flexible heat moldable sheet disposed between the first flexible heat moldable sheet and the back outer layer, wherein the second flexible heat moldable sheet is disposed such that the wearer's hand is to be inserted into the glove in between the first and second flexible heat moldable sheets; and a temperature sensitive indicator configured to undergo a visible change when the predetermined temperature is reached, wherein the temperature sensitive indicator is disposed directly on an outer surface of the front outer layer or an outer surface of the back outer layer;

wherein the first and second flexible heat moldable sheets are configured to conform to at least a portion of a wearer's hand when heated to the predetermined temperature to provide the wearer with a customized fit for the athletic glove, wherein each of the first and second flexible heat moldable sheets comprises a fabric and a thermoplastic resin, and wherein at least one of the first and second flexible heat moldable sheets further comprises a polyurethane coating.

20. The athletic glove of claim 19, wherein the predetermined temperature is in a range from about 120 degrees Fahrenheit to about 220 degrees Fahrenheit.

21. The athletic glove of claim 19, wherein the predetermined temperature is in a range from about 120 degrees Fahrenheit to about 140 degrees Fahrenheit.

22. The athletic glove of claim 19, wherein the thermoplastic resin comprises an ethylene based resin.

23. The athletic glove of claim 19, wherein at least one of the first and second flexible heat moldable sheets is a non-foam material.

24. The athletic, glove of claim 19, wherein the first flexible heat moldable sheet defines a front side of a hand cavity within the athletic glove, and wherein the second flexible heat molded sheet defines a back side of a hand cavity within the athletic glove.

25. An athletic glove, comprising:

a front outer layer and a back outer layer having a periphery, wherein the front outer layer and the back outer, layer are attached about a portion of their peripheries and define an opening for receiving a hand, a plurality of finger portions, and a palm area;

a flexible heat moldable sheet disposed between the front outer layer and the back outer layer configured to conform to at least a portion of a wearers hand when heated to a predetermined temperature to provide the wearer with a customized fit for the athletic glove; and a temperature sensitive indicator configured to undergo a visible change when the predetermined temperature is reached, wherein the temperature sensitive indicator is disposed directly on an outer surface of the front outer layer or an outer surface of the back outer layer.

26. The athletic glove of claim 25, wherein the visible change is a change in color.

27. The athletic glove of claim 25, wherein the temperature sensitive indicator comprises a substrate coated with a temperature sensitive ink.

28. A method for providing a customized fit of an athletic glove for a wearer, the method comprising:

heating the athletic glove at a predetermined temperature for a predetermined amount of time such that a wearer's hand may be inserted into the athletic glove to allow a flexible heat moldable sheet of the glove to conform to a portion of the wearer's hand, wherein the athletic glove comprises a front outer layer and a back outer layer each having a periphery a flexible heat moldable sheet disposed between the front outer layer and the back outer, and a temperature sensitive indicator disposed directly on an outer surface of the front outer layer or an outer surface of the back outer layer and configured to undergo a visible chance when the predetermined temperature is reached, wherein the front outer layer and the back outer layer are attached about a portion of their peripheries and define an opening for receiving a hand, a plurality of finger portions, and a palm area, and wherein the flexible heat moldable sheet comprises a fabric and a thermoplastic resin.

29. The method of claim 28, wherein the predetermined temperature is in a range of from about 120 degrees Fahrenheit to about 220 degrees Fahrenheit.

30. The method of claim 28, wherein the visible change is a change in color.

31. The method of claim 28, further comprising conforming the flexible heat moldable sheet of the glove to a portion of the wearer's hand.

* * * * *

UNITED STATES PATENT AND TRADEMARK OFFICE

CERTIFICATE OF CORRECTION

PATENT NO. : 9,295,299 B2
APPLICATION NO. : 13/457201
DATED : March 29, 2016
INVENTOR(S) : Kevin Leary et al.

It is certified that error appears in the above-identified patent and that said Letters Patent is hereby corrected as shown below:

In the specification,

At column 13, line 63: "FIG. 15, In some embodiments" should read --FIG. 15. In some embodiments--.

In the claims,

At column 16, line 40 (claim 15): "The athletic, glove of claim 1," should read --The athletic glove of claim 1,--.

At column 17, line 26 (claim 24): "The athletic, glove of claim 19," should read --The athletic glove of claim 19,--.

At column 17, line 33 (claim 25): "front outer layer and the back outer, layer" should read --front outer layer and the back outer layer--.

At column 18, line 20 (claim 28): "having a periphery a flexible heat" should read --having a periphery, a flexible heat--.

At column 18, line 25 (claim 28): "undergo a visible chance" should read --undergo a visible change--.

Signed and Sealed this
Twenty-first Day of June, 2016

Michelle K. Lee

Michelle K. Lee
*Director of the United States Patent and Trademark Office*